US011341889B2

(12) United States Patent
Seo et al.

(10) Patent No.: US 11,341,889 B2
(45) Date of Patent: May 24, 2022

(54) DISPLAY DEVICE AND DRIVING METHOD THEREOF

(71) Applicant: SAMSUNG DISPLAY CO., LTD., Yongin-si (KR)

(72) Inventors: Hae Kwan Seo, Yongin-si (KR); Woo Mi Bae, Yongin-si (KR); Young Ha Sohn, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/197,302

(22) Filed: Mar. 10, 2021

(65) Prior Publication Data

US 2021/0407364 A1 Dec. 30, 2021

(30) Foreign Application Priority Data

Jun. 25, 2020 (KR) ..... 10-2020-0078094

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2310/08* (2013.01); *G09G 2330/021* (2013.01)

(58) Field of Classification Search
CPC ..... G09G 3/2003; G09G 2310/08; G09G 2300/0452; G09G 2330/021; G09G 2310/027
See application file for complete search history.

(56) References Cited

U.S. PATENT DOCUMENTS

| | | | | |
|---|---|---|---|---|
| 9,886,882 | B2 * | 2/2018 | He | G09G 3/2051 |
| 10,706,771 | B2 | 7/2020 | Hwang et al. | |
| 2009/0219306 | A1 * | 9/2009 | Oh | G09G 3/3225 345/690 |
| 2009/0225105 | A1 * | 9/2009 | Park | G09G 3/3688 345/690 |
| 2011/0254759 | A1 * | 10/2011 | Mori | G09G 3/3607 345/88 |
| 2012/0086743 | A1 * | 4/2012 | Shiomi | G09G 3/3659 345/694 |

(Continued)

FOREIGN PATENT DOCUMENTS

| | | | |
|---|---|---|---|
| KR | 1020190107216 | A | 9/2019 |
| KR | 20200020191 | A | 2/2020 |

*Primary Examiner* — Grant Sitta
(74) *Attorney, Agent, or Firm* — Cantor Colburn LLP

(57) ABSTRACT

A display device includes a pixel unit including first and second pixel columns arranged alternately along a first direction, and a third pixel column arranged between the first and the second pixel columns, a timing controller generating first or second image data by converting input image data, and a data driver generating a data voltage corresponding to the first or second image data and supplying the data voltage to the pixel unit. The first and second pixel columns each include first and second color pixels arranged alternately along a second direction, the third pixel column includes a third color pixel arranged along the second direction, and the timing controller compares a difference value between a grayscale value of the first color pixel and a grayscale value of the second color pixel with a reference value, and generates the second image data based on a comparing result.

18 Claims, 9 Drawing Sheets

(56) References Cited

U.S. PATENT DOCUMENTS

| | | | | |
|---|---|---|---|---|
| 2013/0120472 | A1* | 5/2013 | Byun | G09G 5/02 345/690 |
| 2015/0049123 | A1* | 2/2015 | Choi | G09G 3/2003 345/690 |
| 2015/0255025 | A1* | 9/2015 | Chen | G09G 3/3607 345/589 |
| 2017/0069250 | A1* | 3/2017 | Wang | G09G 3/2074 |
| 2018/0130856 | A1* | 5/2018 | Kim | H01L 27/3218 |
| 2018/0137830 | A1* | 5/2018 | Lee | G09G 3/3607 |
| 2018/0277049 | A1* | 9/2018 | Pan | G09G 3/2074 |
| 2019/0385548 | A1* | 12/2019 | Chen | G09G 3/3688 |

* cited by examiner

DISPLAY DEVICE AND DRIVING METHOD THEREOF

This application claims priority to Korean Patent Application No. 10-2020-0078094, filed on Jun. 25, 2020, and all the benefits accruing therefrom under 35 U.S.C. § 119, the content of which in its entirety is herein incorporated by reference.

BACKGROUND

Field

Embodiments of the invention relate to a display device and a driving method thereof.

Description of the Related Art

With a development of information technology, an importance of display devices, which are a connection medium between users and information, has been emphasized. In this regard, a use of display devices such as a liquid crystal display device, an organic light emitting display device, a plasma display device, and the like is increasing.

A display device may include red sub-pixels, green sub-pixels, and blue sub-pixels arranged in a stripe shape or a pentile matrix shape.

In a pixel arrangement structure of the pentile matrix shape, the red sub-pixels and the blue sub-pixels are alternately formed in the same column, and the green sub-pixels are formed in an adjacent column. When the pixel arrangement structure of the pentile matrix shape is applied to the display device, a high resolution expression capability is improved, and a vertical line pattern by specific pixels is not visually recognized. Therefore, image quality may be improved.

SUMMARY

When a red image or a blue image is displayed on a display device to which a pixel arrangement structure of a pentile matrix shape is applied, power consumption may be unnecessarily increased since a voltage applied to a data line connected to a red sub-pixel and a blue sub-pixel are alternately changed.

A technical problem to be solved by embodiments of the invention is to provide a display device capable of reducing the power consumption.

However, technical problems to be solved by embodiments of the invention are not limited to the above-described technical problem, and other technical problems not mentioned will be clearly understood by those skilled in the art from the following description.

In order to solve the above technical problem, a display device in an embodiment of the invention may include a pixel unit including a first pixel column and a second pixel column arranged alternately along a first direction, the first pixel column and the second pixel column each comprising a first color pixel and a second color pixel such that an arrangement order of the first color pixel and the second color pixel of the first pixel column along a second direction intersecting the first direction is opposite to an arrangement order of the first color pixel and the second color pixel of the second pixel column along the second direction and a third pixel column arranged between the first pixel column and the second pixel column, the third pixel column comprising a third color pixel arranged along the second direction, a timing controller which generates first image data or second image data by converting input image data provided from an outside, and a data driver which generates a data voltage corresponding to the first image data or the second image data provided from the timing controller and supplies the data voltage to the pixel unit. The first pixel column and the second pixel column may include a first color pixel and a second color pixel arranged alternately in an order opposite to each other along a second direction intersecting the first direction, the third pixel column may include a third color pixel arranged along the second direction, and the timing controller may compare a difference value between a grayscale value of the first color pixel and a grayscale value of the second color pixel with a reference value which is preset, and generate the second image data by adjusting at least one grayscale value of the first color pixel and the second color pixel when the difference value is greater than the reference value.

In an embodiment, when the difference value is smaller than the reference value, the timing controller may generate the first image data by converting the input image data without adjusting the input image data.

In an embodiment, when the grayscale value of the second color pixel is greater than the grayscale value of the first color pixel, the timing controller may change the grayscale value of the first color pixel to be equal to the grayscale value of the second color pixel.

In an embodiment, the timing controller may gradually change the grayscale value of the first color pixel in units of image frames.

In an embodiment, the timing controller may change the grayscale value of the first color pixel and the grayscale value of the second color pixel to a predetermined grayscale value between the grayscale value of the first color pixel and the grayscale value of the second color pixel.

In an embodiment, the timing controller may change at least one of the grayscale value of the first color pixel and the grayscale value of the second color pixel so that the difference value is equal to or less than the reference value.

In an embodiment, a first color of the first color pixel may be red, a second color of the second color pixel may be blue, and a third color of the third color pixel may be green.

In an embodiment, the timing controller may include a mode input unit, and the mode input unit may generate an active signal in response to a mode signal provided from the outside. The timing controller may generate the second image data when the active signal is activated, and generate the first image data by converting the input image data without adjusting the input image data when the active signal is deactivated.

In an embodiment, the pixel unit may include a first area and a second area. The timing controller may include a first determination unit, and the first determination unit may generate an area selection signal for selecting one of the first area and the second area by analyzing the input image data. The timing controller may compare the difference value with the reference value in a selected area of the first area and the second area.

In an embodiment, the timing controller may include a second determination unit, and the second determination unit may generate a grayscale adjustment signal for adjusting the at least one grayscale value of the first color pixel and the second color pixel by analyzing the input image data when the difference value is greater than the reference value.

In an embodiment, the timing controller may include a data converter, and the data converter may convert the input image data into the second image data in which the at least one grayscale value of the first color pixel and the second color pixel is adjusted in response to the grayscale adjustment signal.

In an embodiment, the input image data may include first color input image data, second color input image data, and third color input image data. The data converter may include a grayscale adjustment unit, and the grayscale adjustment unit may generate adjusted first color input image data or adjusted second color input image data by adjusting at least one of the first color input image data and the second color input image data in response to the grayscale adjustment signal.

In an embodiment, the data converter may further include a signal converter, and the signal converter may generate one of the first image data and the second image data by converting one of the first color input image data and the adjusted first color input image data, one of the second color input image data and the adjusted second color input image data, and the third color input image data.

In order to solve the above technical problem, in an embodiment of the invention, a driving method of a display device including a pixel unit including a first pixel column and a second pixel column arranged alternately along a first direction, the first pixel column and the second pixel column each comprising a first color pixel and a second color pixel such that an arrangement order of the first color pixel and the second color pixel of the first pixel column along a second direction intersecting the first direction is opposite to an arrangement order of the first color pixel and the second color pixel of the second pixel column along the second direction, and a third pixel column arranged between the first pixel column and the second pixel column, the third pixel column including a third color pixel arranged along the second direction, may include generating an active signal in response to a mode signal provided from an outside, comparing a difference value between a grayscale value of the first color pixel and a grayscale value of the second color pixel included in input image data with a reference value preset when the active signal is activated, generating a corrected input image data by adjusting at least one grayscale value of the first color pixel and the second color pixel so that the difference value is less than or equal to the reference value when the difference value is greater than the reference value, and converting the corrected input image data into image data and outputting the image data to a data driver.

In an embodiment, when the active signal is deactivated, the image data may be generated by converting the input image data without adjusting the input image data.

In an embodiment, the driving method may further include selecting a portion of the pixel unit as an adjustment area by analyzing the input image data after the generating the active signal, and the difference value between the grayscale value of the first color pixel and the grayscale value of the second color pixel may be compared with the reference value in the adjustment area.

In an embodiment, when the difference value is smaller than the reference value, the image data may be generated by converting the input image data without adjusting the input image data.

In an embodiment, when the grayscale value of the second color pixel is greater than the grayscale value of the first color pixel, the grayscale value of the first color pixel may be changed to be equal to the grayscale value of the second color pixel.

In an embodiment, the grayscale value of the first color pixel may be gradually changed in units of image frames.

In an embodiment, the grayscale value of the first color pixel and the grayscale value of the second color pixel may be changed to a predetermined grayscale value between the grayscale value of the first color pixel and the grayscale value of the second color pixel.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
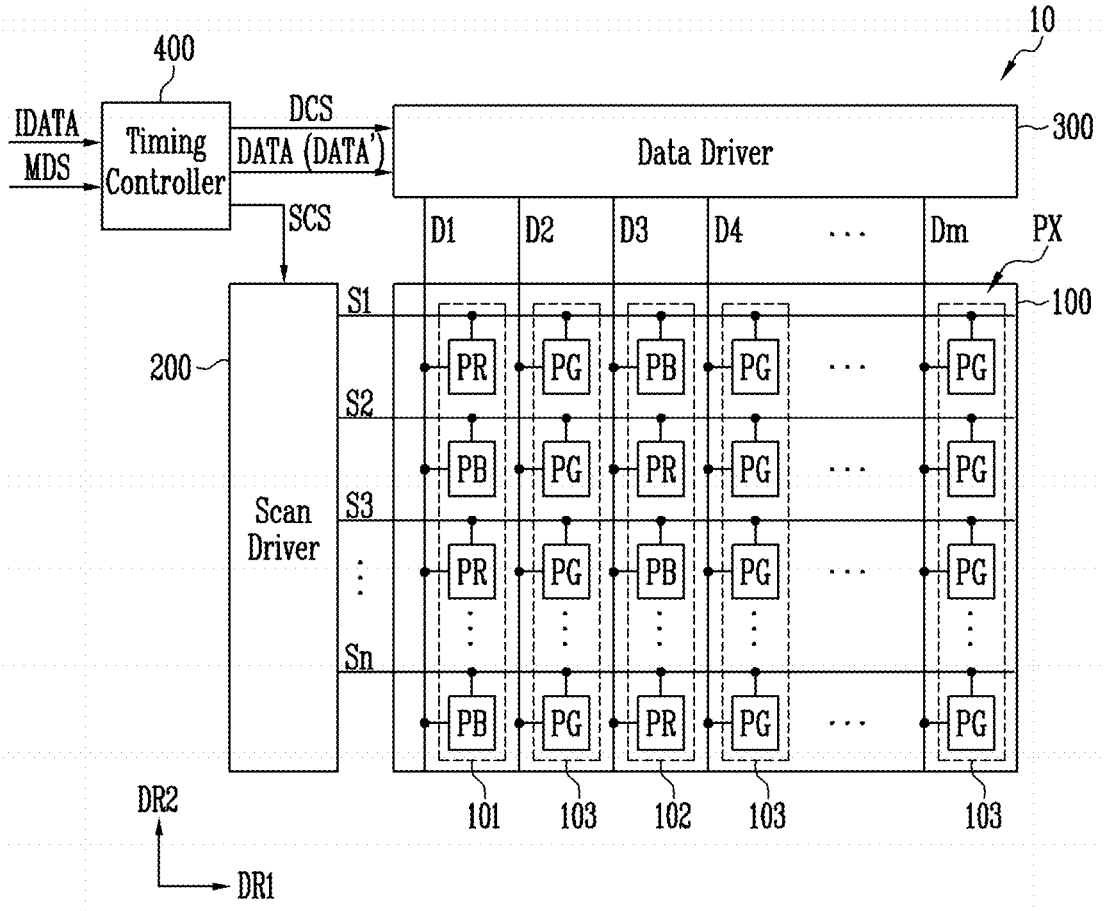
FIG. 1 is a block diagram illustrating an embodiment of a display device according to the invention.

Advantages and features of the invention, and methods for accomplishing the same will be more clearly understood from embodiments described below with reference to the accompanying drawings. However, the invention is not limited to the following embodiments but may be implemented in various different forms. The embodiments are provided only to complete the disclosure of the invention and to fully inform a person having ordinary skill in the art to which the invention pertains the scope of the invention. The present invention is only defined by the scope of the appended claims.

Shapes, sizes, ratios, angles, numbers, and the like shown in the drawings for describing the embodiments are exemplary, and thus, the invention is not limited thereto. Like reference numerals generally refer to like elements throughout the disclosure. In addition, parts not related to the invention in the drawings may be omitted or simply expressed in order to clarify the description of the invention.

Although the terms first, second, etc. may be used herein to describe various components, these components should not be limited by these terms. These terms are only used to distinguish one component from another component. Thus, a first component discussed below may be a second component within the technical spirit of the invention. Singular expressions include plural expressions unless the context clearly indicates otherwise.

Features of each of the embodiments of the present invention can be coupled or combined with each other, partly or wholly, and can be variously interlocked and driven in a technical manner. Each of the embodiments may be implemented independently of each other, or may be implemented together in an association.

Hereinafter, embodiments of the invention will be described in detail with reference to the accompanying drawings.

FIG. 1 is a block diagram illustrating an embodiment of a display device according to the invention.

Referring to FIG. 1, a display device 10 in an embodiment of the invention may include a pixel unit 100, a scan driver 200, a data driver 300, and a timing controller 400.

The pixel unit 100 may have a pixel arrangement structure of a pentile matrix shape. Specifically, the pixel unit 100 (or a display panel) may include a first pixel column 101 and a second pixel column 102 arranged alternately along a first direction DR1, and a third pixel column 103 arranged between the first pixel column 101 and the second pixel column 102.

The first pixel column 101 may include a first pixel PR (or a first color pixel) and a second pixel PB (or a second color pixel) arranged alternately along a second direction DR2 intersecting the first direction DR1.

The second pixel column 102 may include the second pixel PB and the first pixel PR arranged alternately in an order opposite to the first pixel column 101 along the second direction DR2.

The third pixel column 103 may include a third pixel PG (or a third color pixel) arranged along the second direction DR2.

The first pixel PR, the second pixel PB, and the third pixel PG included in the pixel unit 100 may be pixels that emit light of different colors. In an embodiment, the first pixel PR displays light of a first color, the second pixel PB displays light of a second color, and the third pixel PG displays light of a third color, for example. In an embodiment, the first pixel PR may be a red pixel emitting red light, the second pixel PB may be a blue pixel emitting blue light, and the third pixel PG may be a green pixel emitting green light.

Pixels PR, PB, and PG may be connected to corresponding data lines D1 to Dm and corresponding scan lines S1 to Sn, respectively, where m and n are positive integers. Pixels included in the same pixel column may be connected to the same data line. In an embodiment, the first pixel PR and the second pixel PB included in the first pixel column 101 may be connected to the same first data line D1, and the second pixel PB and the first pixel PR included in the second pixel column 102 may be connected to the same second data line D2, for example.

Hereinafter, the position of each of the pixels PR, PB, and PG is described based on the position of a light emitting element (especially, a light emitting layer). The position of a pixel circuit connected to each light emitting element may not correspond to the position of the light emitting element, and may be appropriately disposed within the pixel unit 100 for space efficiency.

The scan driver 200 (or a gate driver) may generate scan signals based on a scan control signal SCS of the timing controller 400 and provide the generated scan signals to the scan lines S1 to Sn. In an embodiment, the scan driver 200 may sequentially provide the scan signals having turn-on level pulses to the scan lines S1 to Sn, for example. Here, the turn-on level may be a voltage level that turns on a transistor. In an embodiment, the scan driver 200 may be configured in the form of a shift register including a plurality of stage circuits, and may generate the scan signals by sequentially transmitting a scan start signal having a turn-on level pulse from the current stage circuit to the next stage circuit in response to a clock signal, for example. Accordingly, the scan driver 200 may provide the scan signals to the pixel unit 100.

The data driver 300 (or a source driver) may generate data voltages based on a data control signal DCS and image data DATA or DATA' of the timing controller 400 and provide the generated data voltages to the data lines D1 to Dm. In an embodiment, the image data DATA or DATA' may be data including information on grayscale values of the pixels PR, PB, and PG, for example. The data driver 300 may sample the image data using a clock signal and provide the data voltages corresponding to the image data to the data lines D1 to Dm in units of pixel rows.

The timing controller 400 may generate the scan control signal SCS, the data control signal DCS, and the image data DATA or DATA' based on input image data IDATA and control signals provided from an external processor (not shown). The input image data IDATA may include the grayscale values, and the control signals may include a vertical synchronization signal, a horizontal synchronization signal, a clock signal, and a mode signal MDS.

The timing controller 400 may provide the data control signal DCS (for example, a data enable signal corresponding to a vertical start signal) and the image data DATA or DATA' to the data driver 300. Also, the timing controller 400 may provide the scan control signal SCS (for example, the clock signal and the scan start signal corresponding to the vertical start signal) to the scan driver 200.

A processor (not shown) may include an application processor, a central processing unit ("CPU"), a graphics processing unit ("GPU"), and the like. The processor may provide the display device 10 with the grayscale values matching a pentile arrangement structure or an RGB stripe arrangement structure as the pixel arrangement structure of the pixel unit 100.

In an embodiment, when the input image data IDATA includes the grayscale values that do not match the pixel arrangement structure of the pixel unit 100, the timing controller 400 may render the grayscale values to generate rendered grayscale values that correspond one-to-one with the pixels PR, PB, and PG included in the pixel unit 100, and provide the rendered grayscale values (or the image data DATA or DATA') to the data driver 300.

As described above, the timing controller 400 may receive the mode signal MDS from an outside. The timing controller 400 may convert the input image data IDATA into the image data DATA or DATA' in response to the mode signal MDS. Here, the image data DATA (or first image data) may be data in which the grayscale values are not corrected, and the image data DATA' (or second image data) may be data in which the grayscale values are corrected.

The timing controller 400 may adjust at least some of the grayscale values included in the input image data IDATA in response to the mode signal MDS, and generate the image data DATA' based on the input image data IDATA whose grayscale values are adjusted. The process of generating the image data DATA and DATA' in the timing controller 400 will be described later with reference to FIGS. 6 and 7.

In the above-described embodiment, the timing controller 400 may be configured separately from the data driver 300. However, according to another embodiment, the timing controller 400 may be integrally provided with the data driver 300.

Figure 2:
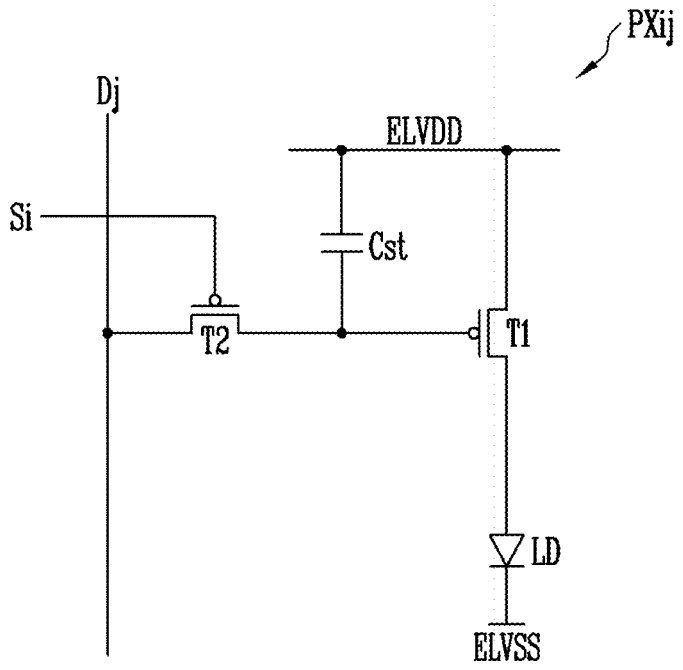
FIG. 2 is a circuit diagram illustrating an example of a pixel included in the display device of FIG. 1.
Figure 3:
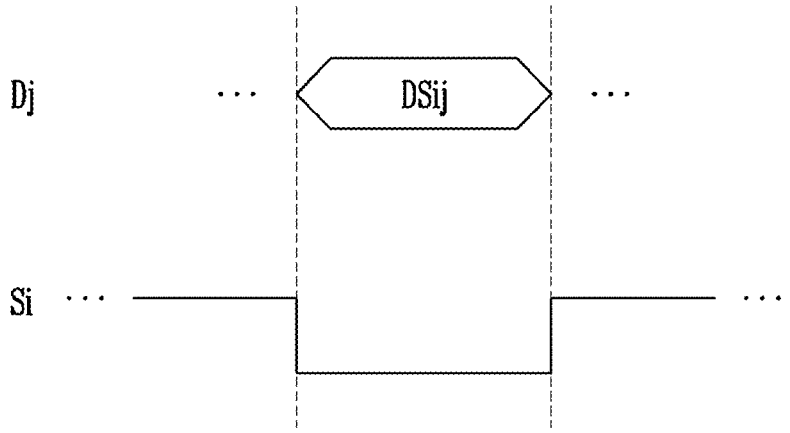
FIG. 3 is a waveform diagram illustrating an operation of the pixel of FIG. 2.

FIG. 2 is a circuit diagram illustrating an example of a pixel included in the display device of FIG. 1. FIG. 3 is a waveform diagram illustrating an operation of the pixel of FIG. 2. The pixels PR, PB, and PG shown in FIG. 1 may be substantially the same as or similar to each other. Therefore, a pixel PXij positioned in an i-th pixel row and a j-th pixel column (i and j are positive integers) will be described to comprehensively represent the pixels PR, PB, and PG.

Referring to FIGS. 2 and 3, the pixel PXij may include a first transistor T1, a second transistor T2, a storage capacitor Cst, and a light emitting element LD.

The transistors may be p-type transistors, for example, p-type metal-oxide-semiconductor ("PMOS") transistors. However, the invention is not limited thereto. In an embodiment, at least one of the transistors may be an n-type transistor, for example, n-type metal-oxide-semiconductor ("NMOS") transistor, for example.

A first electrode of the first transistor T1 may be connected to a first power source line ELVDD, and a second electrode of the first transistor T1 may be connected to an anode of the light emitting element LD (or a light emitting diode). A gate electrode of the first transistor T1 may be connected to a second electrode of the second transistor T2. In an embodiment, the first transistor T1 may be also referred to as a driving transistor.

A first electrode of the second transistor T2 may be connected to a data line Dj, and the second electrode of the second transistor T2 may be connected to the gate electrode of the first transistor T1. A gate electrode of the second transistor T2 may be connected to a scan line S1. In an embodiment, the second transistor T2 may be also referred to as a scan transistor and a switching transistor.

The storage capacitor Cst may be connected or provided between the first electrode of the first transistor T1 (or the first power source line ELVDD) and the gate electrode of the first transistor T1.

The anode of the light emitting element LD may be connected to the second electrode of the first transistor T1, and a cathode of the light emitting element LD may be connected to a second power source line ELVSS. The light emitting element LD may include an organic light emitting diode or an inorganic light emitting diode such as a micro light emitting diode ("LED") and a quantum dot light emitting diode. In addition, the light emitting element LD may be a light emitting diode including a composite of an organic material and an inorganic material. FIG. 2 shows the pixel PXij including a single light emitting element LD. However, in another embodiment, the pixel PXij may include a plurality of light emitting elements. The plurality of light emitting elements may be connected in parallel to each other or may be connected in series.

When a scan signal of a turn-on level (for example, a low level) is supplied to the gate electrode of the second transistor T2 through the scan line S1, the second transistor T2 may connect the data line Dj and one electrode of the storage capacitor Cst. In this case, a voltage value according to a difference between a data voltage DSij applied through the data line Dj and a first power source voltage (for example, a voltage supplied to the first power source line ELVDD) may be written to the storage capacitor Cst.

The first transistor T1 may cause a driving current corresponding to the voltage written to the storage capacitor Cst to flow from the first power source line ELVDD to the second power source line ELVSS. In this case, the light emitting element LD may emit light with luminance corresponding to the amount of the driving current.

Figure 4:
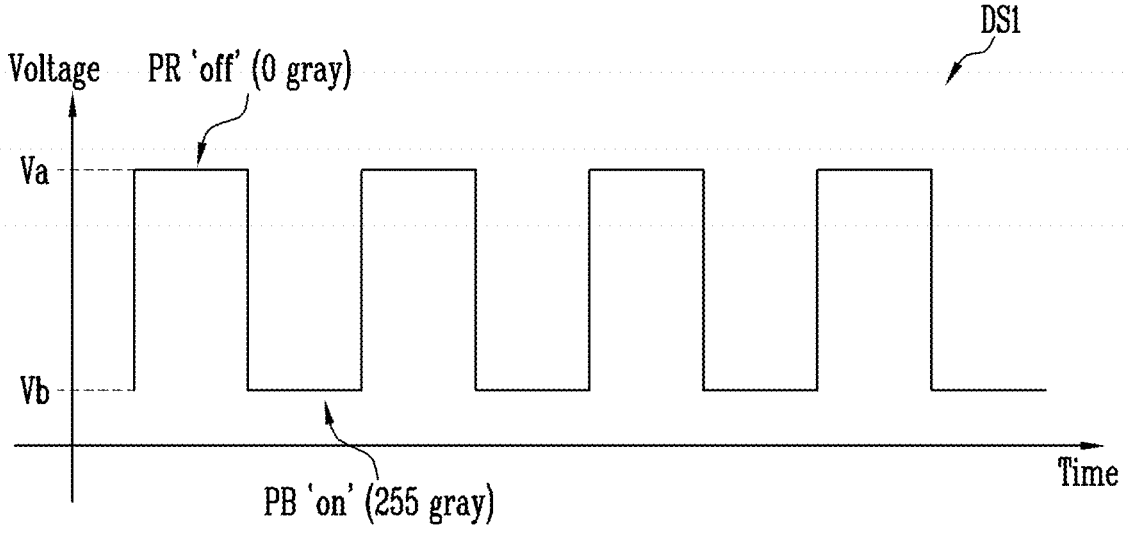
FIG. 4 is a waveform diagram illustrating an example of a first data voltage provided to a first data line included in the display device of FIG. 1.

FIG. 4 is a waveform diagram illustrating an example of a first data voltage provided to a first data line included in the display device of FIG. 1. FIG. 4 shows a first data voltage DS1 applied to the first data line D1 among the data lines D1 to Dm of FIG. 1 when the display device 10 displays a second color image (or a blue image).

Referring to FIGS. 1 and 4, the pixel unit 100 of the display device 10 may display the second color image (or the blue image), and the data voltages for displaying the second color image may be provided to the pixel unit 100.

The data voltages may be alternately provided to the first pixel column 101 and the second pixel column 102 including the first pixel PR and the second pixel PB over time. In an embodiment, the first data voltage DS1 provided to the first data line D1 may include a first voltage Va and a second voltage Vb alternately provided with each other over time, for example. In an embodiment, the first voltage Va may be a voltage corresponding to 0 grayscale (0 gray), and may be a voltage that turns off the pixels PR, PB, and PG. The second voltage Vb may be a voltage corresponding to 255 grayscales (255 gray), and may be a voltage that turns on the pixels PR, PB, and PG.

In this embodiment, the first voltage Va may be a voltage higher than the second voltage Vb. However, this may be determined according to the types of transistors included in the pixel circuit. In an embodiment, when each pixel circuit of the pixels PR, PB, and PG includes p-type transistors, the first voltage Va may be a voltage higher than the second voltage Vb. When each pixel circuit of the pixels PR, PB, and PG includes n-type transistors, the first voltage Va may be a voltage lower than the second voltage Vb, for example. Hereinafter, for convenience of description, a case where each of the pixels PR, PB, and PG includes the p-type transistors and the first voltage Va is a voltage higher than the second voltage Vb will be described.

The data driver 300 may alternately provide the first voltage Va and the second voltage Vb through the first data line D1 in synchronization with the scan signals provided through the scan lines S1 to Sn. Accordingly, when the scan signal is provided to a first scan line S1, the first pixel PR connected to the first scan line S1 may be turned off by receiving the first voltage Va through the first data line D1. Also, when the scan signal is provided to a second scan line S2, the second pixel PB connected to the second scan line S2 may receive the second voltage Vb through the first data line D1 to emit light of the second color.

Although not shown in the drawings, a second data voltage including the second voltage Vb and the first voltage Va provided in an order opposite to the first data voltage DS1 may be provided to the second pixel column 102. The first pixel PR may be turned off in response to the second data voltage, and the second pixel PB of the second pixel column 102 may emit light of the second color. In addition, a third data voltage including the first voltage Va that is continuously supplied may be provided to the third pixel column 103 including the third pixel PG. Third pixels PG of the third pixel column 103 may not emit light in response to the third data voltage.

In contrast, when the pixel unit 100 of the display device 10 displays a first color image (or a red image), the second color image may be displayed by providing the second voltage Vb to the first pixel PR of the first pixel column 101 and the second pixel column 102, and the first voltage Va to the second pixel PB.

As described above, when the display device 10 displays the second color image (or the first color image), the voltage applied to the first pixel PR and the second pixel PB may alternately change over time. The data driver 300 may continuously charge and discharge an output amplifier of the data driver 300 to output the data voltage that are alternately changed. Power consumption of the display device 10 may be increased due to the continuous charging and discharging in the data driver 300. Accordingly, in order to reduce the power consumption of the display device 10, the timing controller 400 may include various configurations, and may adjust the data voltages provided by the data driver 300.

Figure 5:
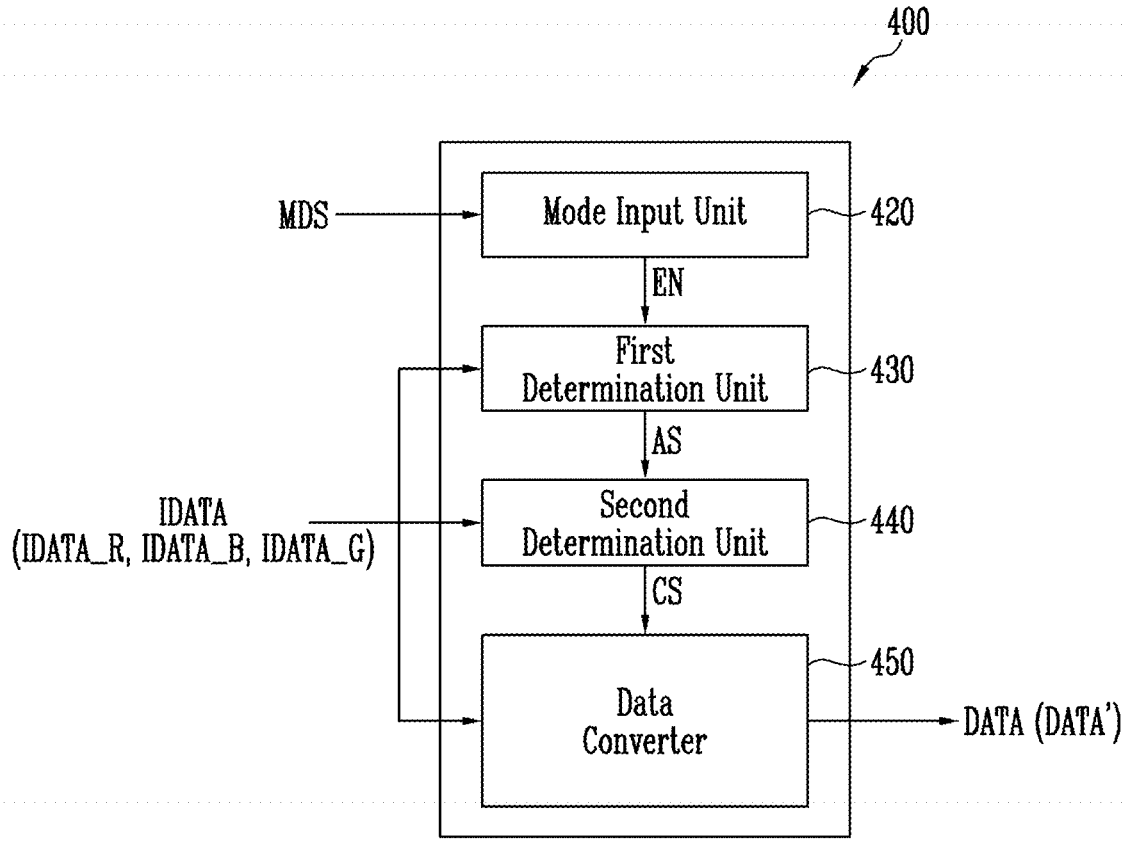
FIG. 5 is a diagram for explaining a timing controller included in the display device of FIG. 1.
Figure 6:
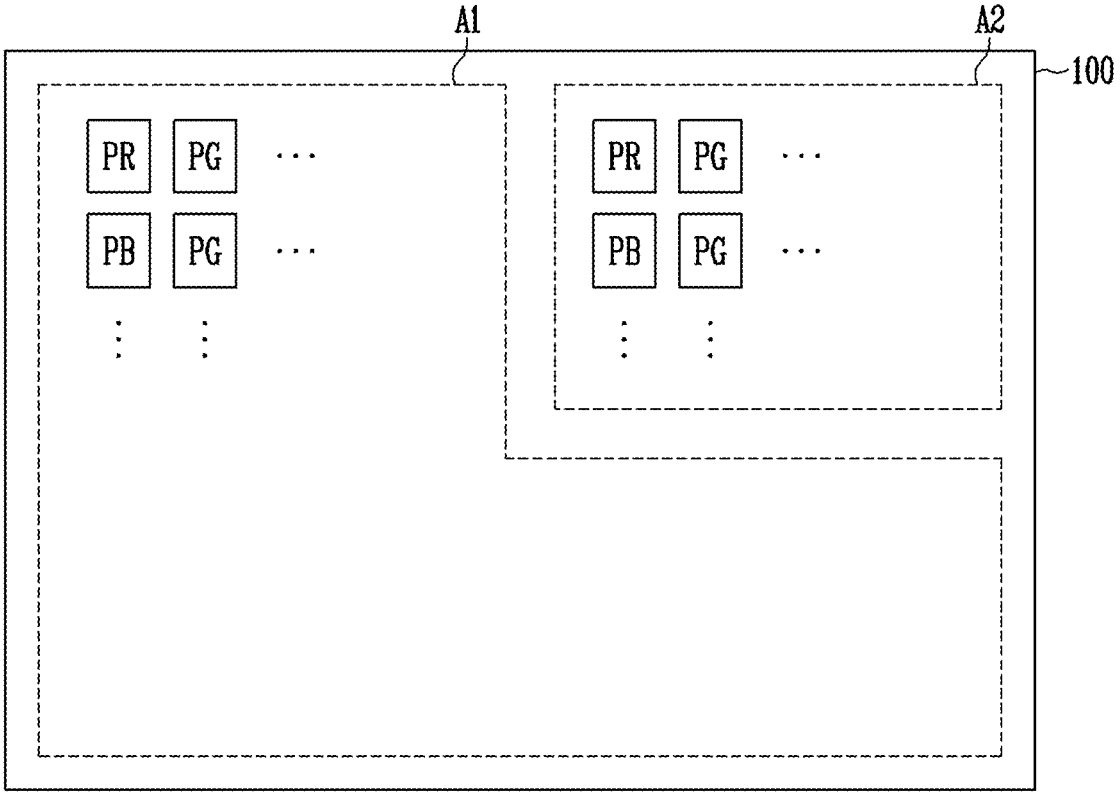
FIG. 6 is a diagram for explaining a first area and a second area of a pixel unit included in the display device of FIG. 1.

FIG. 5 is a diagram for explaining a timing controller included in the display device of FIG. 1. FIG. 6 is a diagram for explaining a first area and a second area of a pixel unit included in the display device of FIG. 1.

Referring to FIGS. 1 and 5, the timing controller 400 may include a mode input unit 420, a first determination unit 430, a second determination unit 440, and a data converter 450.

As described with reference to FIG. 1, the timing controller 400 may receive the input image data IDATA and various control signals from the external processor. The control signals provided to the timing controller 400 may include the mode signal MDS. The timing controller 400 may convert the input image data IDATA into the image data DATA (or the first image data) or corrected image data DATA' (or the second image data) in response to the mode signal MDS and output the image data DATA or DATA' to the data driver 300.

The mode input unit 420 may generate an active signal EN in response to the mode signal MDS provided from the outside. In an embodiment, the mode input unit 420 may include at least one circuit.

The mode signal MDS may be an operation signal for driving a power consumption reduction mode for reducing the power consumption, and may be a signal generated by a user of the display device 10. The display device 10 may be operated in the power consumption reduction mode (or a first mode) when the mode signal MDS is provided, and the display device 10 may be operated in a normal mode (or a second mode) when the mode signal MDS is not provided. In an embodiment, the mode signal MDS may be a signal that may be deactivated by having a low voltage level in the normal mode and activated by having a high voltage level in the power consumption reduction mode. However, the invention is not limited thereto.

In another embodiment, the mode signal MDS may be further subdivided according to a user setting. In an embodiment, in response to the subdivided mode signal MDS, the power consumption reduction mode may be divided into a first power consumption reduction mode and a second power consumption reduction mode, for example. The degree to which the corrected image data DATA' is corrected may be set differently in the first power consumption reduction mode and the second power consumption reduction mode.

The first determination unit 430 may generate an area selection signal AS for setting an area for correcting the image data in response to the active signal EN provided from the mode input unit 420. In an embodiment, the first determination unit 430 may include at least one circuit.

Referring to FIG. 6, in relation to the area selection signal AS, the pixel unit 100 may include a first area A1 and a second area A2. Each of the first area A1 and the second area A2 may include a plurality of pixels PR, PB, and PG.

In an embodiment, the image displayed by the display device through the pixel unit 100 may include a background image that occupies most of the image and an object image displayed on the background image. Here, the object image may be a main part displaying information of the image, and the background image may be a part not related to the main information of the image. In FIG. 6, the first area A1 may mean an area for the above-described background image, and the second area A2 may mean an area for the above-described object image.

The first determination unit 430 may analyze the input image data IDATA to distinguish the first area A1 from which the background image is output and the second area A2 from which the object image is output among the image displayed on the pixel unit 100, and select an adjustment area for correcting the image data among the first area A1 and the second area A2. Specifically, the first determination unit 430 may select an area having a higher ratio of displaying the first color image or the second color image among the first area A1 and the second area A2 compared to the entire pixel unit 100. In an embodiment, when the first area A1 displays the first color image and the second area A2 displays the second color image, the first determination unit 430 may select the first area A1 that occupies a larger area than the second area A2 as the adjustment area and correct the image data, for example.

In an embodiment, the first determination unit 430 may further include a separate algorithm for selecting an area that has little impact on the user and has little rejection felt by the user even when the color of the displayed image is partially changed, among the first area A1 and the second area A2. The first determination unit 430 may select one area more suitable among the first area A1 and the second area A2 based on the corresponding algorithm.

According to design and driving conditions of the display device, the first determination unit 430 may be omitted. In this case, the timing controller 400 may correct the image data for the entire area of the pixel unit 100.

The second determination unit 440 may generate a grayscale adjustment signal CS in response to the area selection signal AS provided from the first determination unit 430. In an embodiment, the second determination unit 440 may include at least one circuit.

The second determination unit 440 may analyze the input image data IDATA, compare a difference value between a grayscale value of the first pixel PR and a grayscale value of the second pixel PB with a reference value previously stored, and generate the grayscale adjustment signal CS according to the compared result.

Specifically, the input image data IDATA may include first color input image data IDATA_R including grayscale value information of the first pixel PR, second color input image data IDATA_B including grayscale value information of the second pixel PB, and third color input image data IDATA_G including grayscale value information of the third pixel PG. The second determination unit 440 may calculate the difference value between the grayscale value of the first pixel PR and the grayscale value of the second pixel PB based on the first color input image data IDATA_R and the second color input image data IDATA_B, and compare the difference value between the grayscale value of the first pixel PR and the grayscale value of the second pixel PB with the reference value.

As described above, the reference value may be a value previously stored in the second determination unit 440, but the invention is not limited thereto. In an embodiment, the reference value may be a value input from the outside in real time. In this case, the reference value may be provided in conjunction with the mode signal MDS described above, and may be used as a value for adjusting the degree to which the image data is corrected. That is, the reference value may be a value that is separately set by the user, and may be set as an arbitrary value between a maximum grayscale value and a minimum grayscale value of the pixel.

As a result of comparing the difference value between the grayscale value of the first pixel PR and the grayscale value of the second pixel PB with the reference value, when the difference value between the grayscale value of the first pixel PR and the grayscale value of the second pixel PB is greater than the reference value, the second determination unit 440 may generate the grayscale adjustment signal CS. The grayscale adjustment signal CS may include information on the degree to which the image data is corrected, and for example, the grayscale adjustment signal CS may include information on the reference value.

Conversely, when the difference value between the grayscale value of the first pixel PR and the grayscale value of the second pixel PB is smaller than the reference value, the second determination unit 440 may not output the grayscale adjustment signal CS, or may output a deactivated grayscale adjustment signal CS.

The data converter 450 may generate the image data DATA or the corrected image data DATA' in response to the grayscale adjustment signal CS provided from the second determination unit 440.

The data converter 450 may receive the input image data IDATA, and convert the input image data IDATA into the image data DATA or the corrected image data DATA' based on the grayscale adjustment signal CS.

Specifically, when the grayscale adjustment signal CS or an activated grayscale adjustment signal CS is provided to the data converter 450, the data converter 450 may adjust at least one of the first color input image data IDATA_R and the second color input image data IDATA_B, and convert the adjusted input image data IDATA into the image data DATA' (or the second image data).

In an alternative embodiment, when the grayscale adjustment signal CS is not provided to the data converter 450, or the deactivated grayscale adjustment signal CS is provided to the data converter 450, the data converter 450 may convert the input image data IDATA into the image data DATA (or the first image data) without adjusting the input image data IDATA.

When the mode signal MDS is not provided to the above-described mode input unit 420 or a deactivated mode signal MDS is provided to the above-described mode input unit 420, the first determination unit 430 and the second determination unit 440 may not analyze the input image data IDATA. Particularly, when the mode signal MDS is not provided, the second determination unit 440 may not generate the grayscale adjustment signal CS. Accordingly, the data converter 450 may convert the input image data IDATA into the image data DATA as it is without adjusting the input image data IDATA. Hereinafter, the data converter 450 will be described in more detail with reference to FIG. 7.

Figure 7:
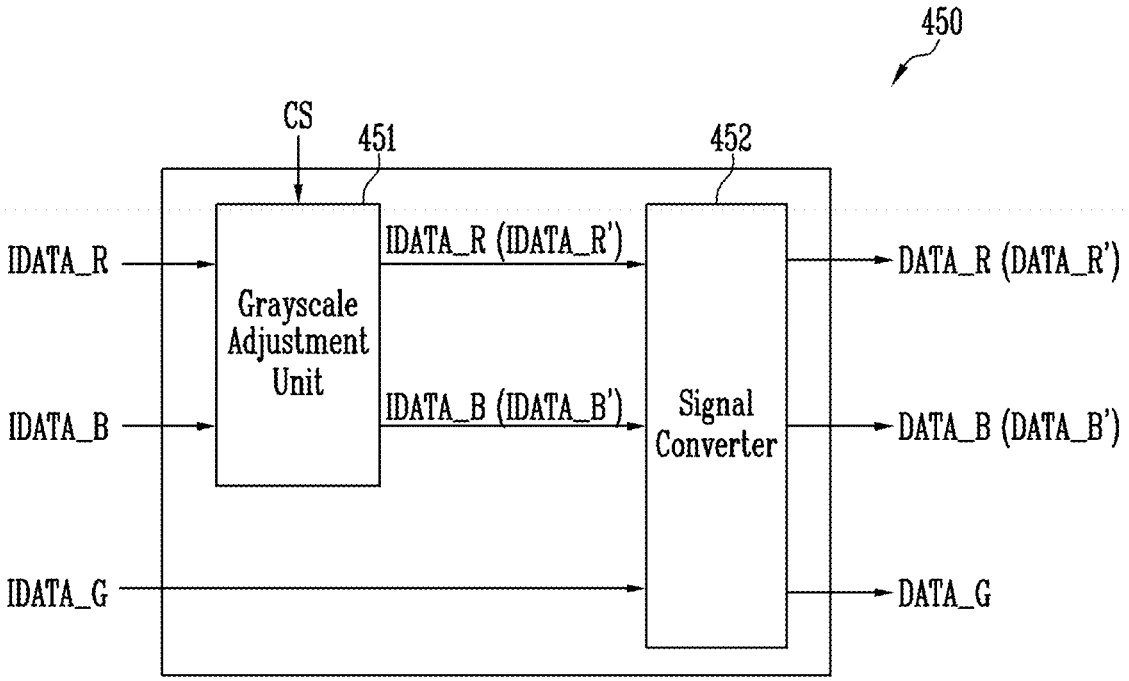
FIG. 7 is a diagram for explaining a data converter included in the timing controller of FIG. 5.

FIG. 7 is a diagram for explaining a data converter included in the timing controller of FIG. 5.

Referring to FIGS. 1, 5 and 7, the data converter 450 may include a grayscale adjustment unit 451 and a signal converter 452.

The grayscale adjustment unit 451 may adjust at least one of the first color input image data IDATA_R and the second color input image data IDATA_B in response to the grayscale adjustment signal CS to generate adjusted first color input image data IDATA_R' or adjusted second color input image data IDATA_B'. In an embodiment, the grayscale adjustment unit 451 may include at least one circuit.

In an embodiment, when the grayscale value of the second pixel PB is greater than the grayscale value of the first pixel PR, the grayscale adjustment unit 451 may generate the adjusted first color input image data IDATA_R' by adjusting the first color input image data IDATA_R so that the grayscale value of the first pixel PR increases in response to the grayscale adjustment signal CS.

In another embodiment, when the grayscale value of the second pixel PB is greater than the grayscale value of the first pixel PR, the grayscale adjustment unit 451 may adjust the grayscale value of the first pixel PR and the grayscale value of the second pixel PB to a predetermined grayscale value between the grayscale value of the first pixel PR and the grayscale value of the second pixel PB in response to the grayscale adjustment signal CS. Accordingly, the grayscale adjustment unit 451 may adjust the first color input image data IDATA_R so that the grayscale value of the first pixel PR increases, and adjust the second color input image data IDATA_B so that the grayscale value of the second pixel PB decreases.

That is, the grayscale adjustment unit 451 may adjust at least one of the first color input image data IDATA_R and the second color input image data IDATA_B so that a difference between the grayscale value of the first pixel PR and the grayscale value of the second pixel PB is reduced in response to the grayscale adjustment signal CS. The grayscale adjustment unit 451 may output the input image data that is not adjusted among the first color input image data IDATA_R and the second color input image data IDATA_B as it is.

In addition, as described above, when the grayscale adjustment signal CS is not provided, the grayscale adjustment unit 451 may output both the first color input image data IDATA_R and the second color input image data IDATA_B as it is.

The signal converter 452 may generate one of the image data DATA_R and the corrected image data DATA_R' by converting one of the first color input image data IDATA_R and the adjusted first color input image data IDATA_R', generate one of the image data DATA_B and the corrected image data DATA_B' by converting one of the second color input image data IDATA_B and the adjusted second color input image data IDATA_B', and generate image data DATA_G by converting the third color input image data IDATA_G.

When the input image data provided from the grayscale adjustment unit 451 includes the grayscale values matching the pixel arrangement structure (for example, a pentile structure) of the pixel unit 100 (shown in FIG. 1), the signal converter 452 may transmit the input image data IDATA to the data driver 300 (shown in FIG. 1). However, when the input image data IDATA includes the grayscale values that are not related to the pixel arrangement structure of the pixel unit 100, the signal converter 452 may further include a rendering unit for rendering the grayscale values. The signal converter 452 may generate rendered grayscale values (or the image data DATA or DATA') that correspond to one-to-one with the pixels PR, PB, and PG (shown in FIG. 1) included in the pixel unit 100, and provide the rendered grayscale values to the data driver 300.

Hereinafter, with reference to FIGS. 1, 4, 5, 7, and 8 to 11, corrected data voltages DS1', DS1*a*, DS1*b*, and DS1*c* output based on the corrected image data DATA' generated by the data converter 450 will be described in detail.

FIGS. 8 to 11 are waveform diagrams illustrating various examples of first data voltages corrected by the data converter of FIG. 7. For convenience of description, a case where the input image data IDATA provided to the timing controller 400 is data for displaying the second color image (or the blue image) will be described as an example. The first data voltages applied to the first data line D1 among the data lines D1 to Dm of FIG. 1 are shown. Hereinafter, differences from the first data voltage DS1 of FIG. 4 will be mainly described.

Figure 8:
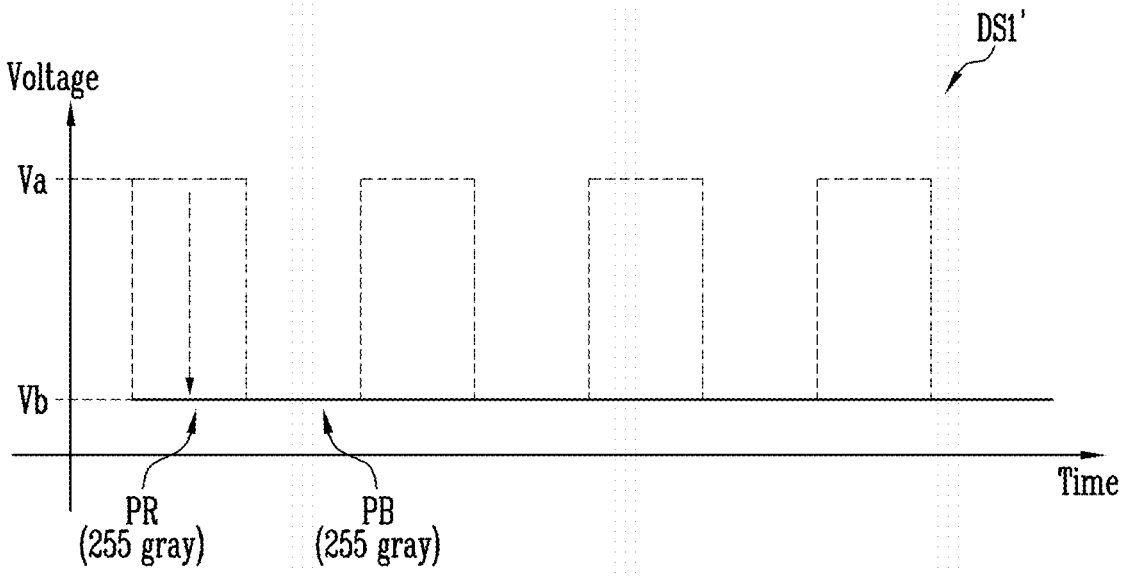
FIGS. 8 to 11 are waveform diagrams illustrating various examples of first data voltages corrected by the data converter of FIG. 7.

As shown in FIG. 8, the timing controller 400 (shown in FIG. 1) may adjust the grayscale value of the first pixel PR to 255 grayscales (255 gray) that is the same as the grayscale value of the second pixel PB. That is, a first data voltage DS1' may provide the second voltage Vb to the first pixel PR, and the first pixel PR may emit light of the first color corresponding to the provided second voltage Vb.

As the first pixel PR emits the light, power consumption may occur in the first pixel PR. However, as the first data voltage DS1' provided to the first pixel PR and the second pixel PB is constantly supplied without charging and discharging, power consumption of the data driver 300 may be reduced, and overall power consumption of the display device 10 may be reduced.

Figure 9:
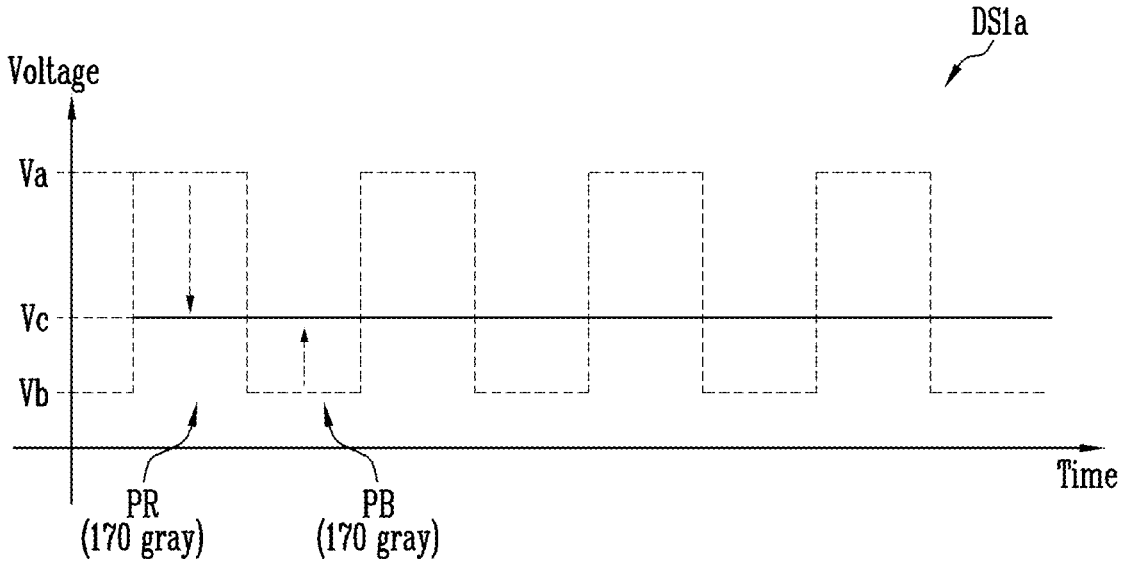

As shown in FIG. 9, the timing controller 400 may adjust the grayscale value of the first pixel PR and the grayscale value of the second pixel PB to a predetermined grayscale value (for example, 170 grayscales (170 gray)) between the grayscale value of the first pixel PR and the grayscale value of the second pixel PB. Accordingly, the grayscale value of the first pixel PR may be increased, and the grayscale value of the second pixel PB may be decreased. That is, a first data voltage DS1*a* may provide a third voltage Vc to the first pixel PR and the second pixel PB. The first pixel PR may emit light of the first color corresponding to the provided third voltage Vc, and the second pixel PB may emit light of the second color corresponding to the provided third voltage Vc.

As described above, as the first pixel PR emits the light, the power consumption may occur in the first pixel PR. However, as the first data voltage DS1*a* provided to the first pixel PR and the second pixel PB is constantly supplied without charging and discharging, the power consumption of the data driver 300 may be reduced, and the overall power consumption of the display device 10 may be reduced.

In addition, as in the embodiment of FIG. 8, as not only the grayscale value of the first pixel PR is increased, but also the grayscale value of the second pixel PB is decreased, the luminance of the changed image provided by the display device 10 may be changed similarly to the luminance of the previously provided image.

Figure 10:
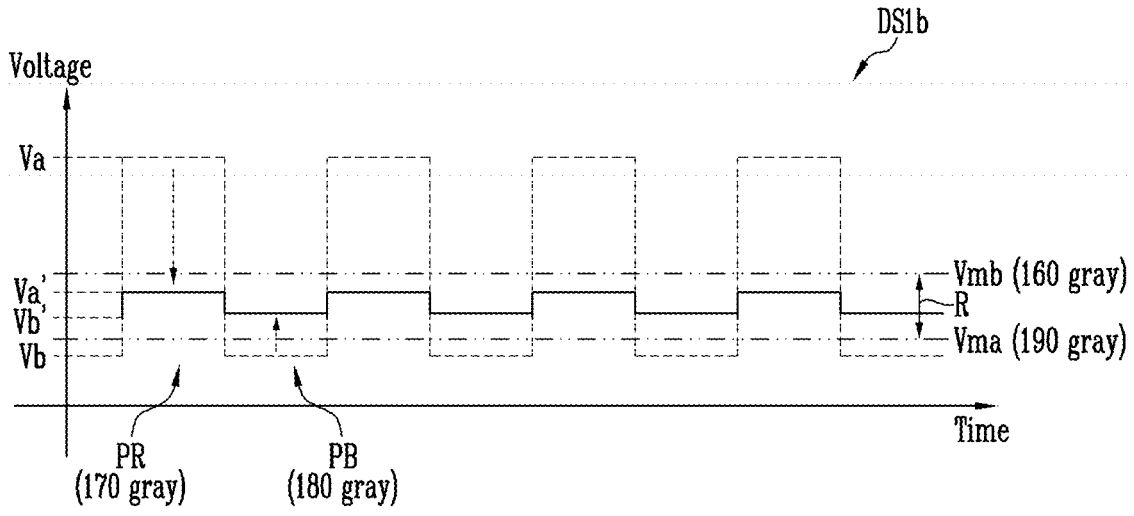

As shown in FIG. 10, the timing controller 400 may adjust the grayscale value of the first pixel PR to be increased to 170 grayscales (170 gray), and adjust the grayscale value of the second pixel PB to be reduced to 180 grayscales (180 gray). That is, a first data voltage DS1*b* may provide a first change voltage Va' to the first pixel PR, and the first pixel PR may emit light of the first color in response to the provided first change voltage Va'. Also, the first data voltage DS1*b* may provide a second change voltage Vb' to the second pixel PB, and the second pixel PB may emit light of the second color in response to the provided second change voltage Vb'.

Here, the first change voltage Va' and the second change voltage Vb' may be voltages within an adjustment range R. The adjustment range R may be a value provided in the process of adjusting the input image data IDATA, and may be, for example, a range corresponding to the reference value of the second determination unit 440 (shown in FIG. 5) described above. In an embodiment, the adjustment range R may be set in a range between a minimum adjustment voltage Vma corresponding to 160 grayscales (160 gray) and a maximum adjustment voltage Vmb corresponding to 190 grayscales (190 gray), for example. However, the adjustment range R may be variously set according to the convenience of the user or manufacturer of the display device.

Unlike the embodiments of FIGS. 8 and 9, the power consumption due to charging and discharging in the data driver 300 may be reduced by reducing a difference between the first change voltage Va' and the second change voltage Vb' of the first data voltage DS1*b* while maintaining the quality of the image displayed by the display device 10 at a constant level through the first change voltage Va' and the second change voltage Vb' different from each other.

Figure 11:
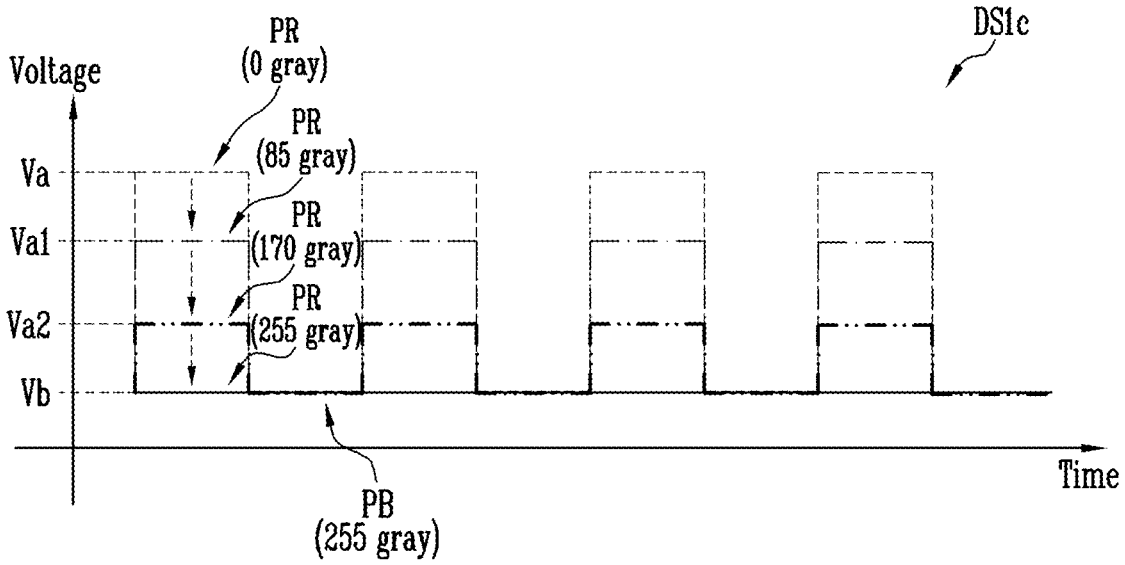

As shown in FIG. 11, the timing controller 400 may gradually adjust the grayscale value of the first pixel PR in units of image frames. In an embodiment, when the grayscale value of the first pixel PR is adjusted from 0 grayscale (0 gray) to 255 grayscales (255 gray), the timing controller 400 may adjust the grayscale value of the first pixel PR in a first image frame to 85 grayscales (85 gray), the grayscale value of the first pixel PR in a second image frame after the first image frame to 170 grayscales (170 gray), and the grayscale value of the first pixel PR in a third image frame after the second image frame to 255 grayscales (255 gray), for example. That is, a first data voltage DS1*c* may provide a first adjustment voltage Va1 to the first pixel PR in the first image frame, a second adjustment voltage Va2 to the first pixel PR in the second image frame, and the second voltage Vb to the first pixel PR in the third image frame.

In the above-described embodiment, the grayscale value of the first pixel PR is described as being adjusted in units of one image frame, but the invention is not limited thereto, and may be adjusted at various time intervals.

As described above, as the grayscale value of the first pixel PR is gradually adjusted, the rejection felt by the user due to a sudden change in color of the displayed image may be minimized, and a more natural image may be provided to the user.

Figure 12:
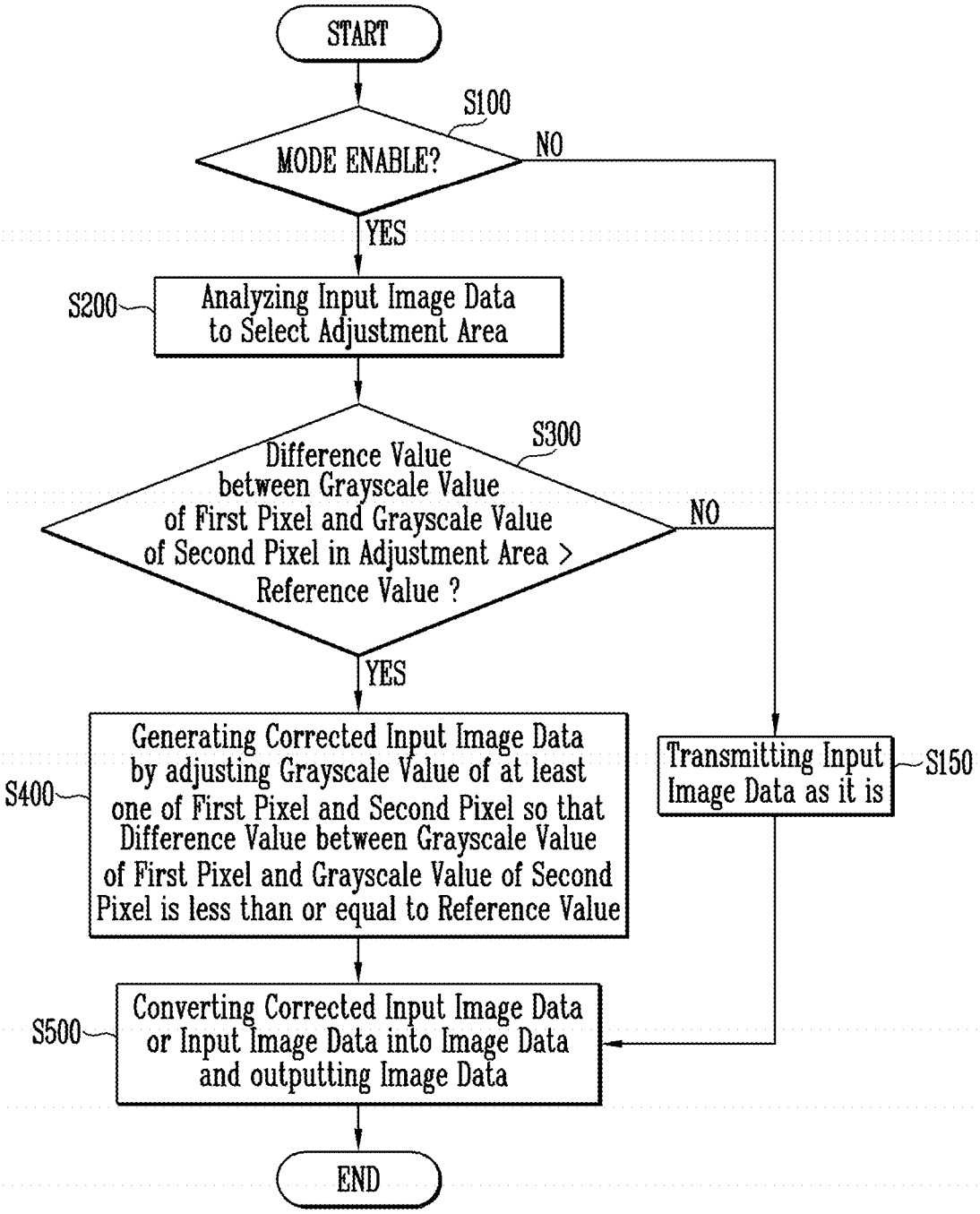
FIG. 12 is a flowchart for explaining an embodiment of a driving method of a display device according to the invention.

FIG. 12 is a flowchart for explaining an embodiment of a driving method of a display device according to the invention. In particular, FIG. 12 is a flowchart illustrating a driving method of the display device shown in FIG. 1.

Referring to FIG. 12 in conjunction with FIGS. 1, 5, and 7, first, the mode input unit 420 of the timing controller 400 of the display device 10 may generate the active signal EN in response to the mode signal MDS provided from the outside (S100).

The mode signal MDS may include information on the power consumption reduction mode (or the first mode) and the normal mode (or the second mode) of the display device 10. In an embodiment, the mode input unit 420 may output an activated active signal EN in the power consumption reduction mode, and may not generate the active signal EN in the normal mode or may generate a deactivated active signal EN.

Next, when the active signal EN is activated, the first determination unit 430 of the timing controller 400 may analyze the input image data IDATA to select a portion of the pixel unit 100 as the adjustment area (S200).

As described above, the adjustment area may be selected as one of the background area and the object area of the pixel unit 100, and may be selected as an area having a high power consumption reduction effect when correcting the image data.

When the active signal EN is deactivated, the timing controller 400 may transmit the provided input image data IDATA to the signal converter 452 without adjustment (S150).

Next, the second determination unit 440 of the timing controller 400 may compare the difference value between the grayscale value of the first pixel PR and the grayscale value of the second pixel PB with the reference value (S300).

In an embodiment, when the timing controller 400 includes the first determination unit 430, the second determination unit 440 may compare the difference value between the grayscale value of the first pixel PR and the grayscale value of the second pixel PB in the adjustment area with the reference value in response to the area selection signal AS provided from the first determination unit 430. In another embodiment, when the timing controller 400 does not include the first determination unit 430, the second determination unit 440 may compare the difference value with the reference value in response to the active signal EN.

According to the compared result, when the difference value between the grayscale value of the first pixel PR and the grayscale value of the second pixel PB is greater than the reference value, the grayscale adjustment unit 451 of the timing controller 400 may generate the corrected input image data DATA by adjusting the grayscale value of at least one of the first pixel PR and the second pixel PB so that the difference value between the grayscale value of the first pixel PR and the grayscale value of the second pixel PB is equal to or less than the reference value (S400).

In an embodiment, when adjusting the grayscale value of the first pixel PR, the grayscale adjustment unit 451 may adjust the first color input image data IDATA_R to generate the adjusted first color input image data IDATA_R'. In addition, when adjusting the grayscale value of the second pixel PB, the grayscale adjustment unit 451 may adjust the second color input image data IDATA_B to generate the adjusted second color input image data IDATA_B'.

In an embodiment, as shown in FIG. 8, the grayscale adjustment unit 451 may increase the grayscale value of the first pixel PR to be the same as the grayscale value of the second pixel PB, for example. In an embodiment, the grayscale value of the first pixel PR may be gradually adjusted as shown in FIG. 11, for example, the grayscale value may be adjusted in units of image frames.

In another embodiment, as shown in FIG. 9, the grayscale adjustment unit 451 may increase the grayscale value of the first pixel PR and decrease the grayscale value of the second pixel PB so that the grayscale value of the first pixel PR and the grayscale value of the second pixel PB are the same.

In another embodiment, as shown in FIG. 10, the grayscale adjustment unit 451 may increase the grayscale value of the first pixel PR and decrease the grayscale value of the second pixel PB, but the grayscale value of the first pixel PR and the grayscale value of the second pixel PB may be adjusted to have different grayscale values within a predetermined adjustment range R.

When the difference value between the grayscale value of the first pixel PR and the grayscale value of the second pixel PB is smaller than the reference value, the grayscale adjustment unit 451 may transmit the provided input image data IDATA to the signal converter 452 without adjustment (S150).

Next, the timing controller 400 may convert the corrected input image data IDATA into image data DATA' and output the converted image data DATA' to the data driver 300 (S500).

The corrected data voltage output from the data driver 300 in response to the corrected image data DATA' may have a smaller voltage difference between output voltages than that of the uncorrected data voltage. Accordingly, the charging and discharging for outputting voltages corresponding to the grayscale value of the first pixel PR and the grayscale value of the second pixel PB in the data driver 300 may be prevented from being repeated, and the power consumption of the display device 10 may be reduced.

According to the embodiments of the invention, the display device capable of reducing the power consumption and the driving method of the same may be provided.

The effects of the embodiments are not limited by the above-described contents, and more various effects are included in the specification. The embodiments of the invention have been described above with reference to the drawings. However, those skilled in the art to which the invention pertains will understand that the invention may be implemented in other specific forms without changing the technical spirit or essential features of the invention. Therefore, it should be understood that the above-described embodiments are illustrative in all respects and not restrictive.

What is claimed is:

1. A display device comprising:

a pixel unit comprising:

a first pixel column and a second pixel column arranged alternately along a first direction, the first pixel column and the second pixel column each comprising a first color pixel and a second color pixel such that an arrangement order of the first color pixel and the second color pixel of the first pixel column along a second direction intersecting the first direction is opposite to an arrangement order of the first color pixel and the second color pixel of the second pixel column along the second direction; and a third pixel column arranged between the first pixel column and the second pixel column, the third pixel column comprising a third color pixel arranged along the second direction;

a timing controller which generates first image data or second image data by converting input image data provided from an outside; and a data driver which generates a data voltage corresponding to the first image data or the second image data provided from the timing controller and supplies the data voltage to the pixel unit, wherein the timing controller compares a difference value between a grayscale value of the first color pixel and a grayscale value of the second color pixel with a reference value which is preset, and generates the second image data by adjusting at least one grayscale value of the first color pixel and the second color pixel when the difference value is greater than the reference value, and wherein when the difference value is smaller than the reference value, the timing controller generates the first image data by converting the input image data without adjusting the input image data.

2. The display device of claim 1, wherein when the grayscale value of the second color pixel is greater than the grayscale value of the first color pixel, the timing controller changes the grayscale value of the first color pixel to be equal to the grayscale value of the second color pixel.

3. The display device of claim 2, wherein the timing controller gradually changes the grayscale value of the first color pixel in units of image frames.

4. The display device of claim 1, wherein the timing controller changes the grayscale value of the first color pixel and the grayscale value of the second color pixel to a predetermined grayscale value between the grayscale value of the first color pixel and the grayscale value of the second color pixel.

5. The display device of claim 1, wherein the timing controller changes at least one of the grayscale value of the first color pixel and the grayscale value of the second color pixel so that the difference value is equal to or less than the reference value.

6. The display device of claim 1, wherein a first color of the first color pixel is red, a second color of the second color pixel is blue, and a third color of the third color pixel is green.

7. The display device of claim 1, wherein the timing controller comprises a mode input unit, and the mode input unit generates an active signal in response to a mode signal provided from the outside, and wherein the timing controller generates the second image data when the active signal is activated, and generates the first image data by converting the input image data without adjusting the input image data when the active signal is deactivated.

8. The display device of claim 1, wherein the pixel unit comprises a first area and a second area, wherein the timing controller comprises a first determination unit, and the first determination unit generates an area selection signal for selecting one of the first area and the second area by analyzing the input image data, and wherein the timing controller compares the difference value with the reference value in a selected area of the first area and the second area.

9. The display device of claim 1, wherein the timing controller comprises a second determination unit, and the second determination unit generates a grayscale adjustment signal for adjusting the at least one grayscale value of the first color pixel and the second color pixel by analyzing the input image data when the difference value is greater than the reference value.

10. The display device of claim 9, wherein the timing controller comprises a data converter, and the data converter converts the input image data into the second image data in which the at least one grayscale value of the first color pixel and the second color pixel is adjusted in response to the grayscale adjustment signal.

11. The display device of claim 10, wherein the input image data comprises first color input image data, second color input image data, and third color input image data, and wherein the data converter comprises a grayscale adjustment unit, and the grayscale adjustment unit generates adjusted first color input image data or adjusted second color input image data by adjusting at least one of the first color input image data and the second color input image data in response to the grayscale adjustment signal.

12. The display device of claim 11, wherein the data converter further comprises a signal converter, and the signal converter generates one of the first image data and the second image data by converting one of the first color input image data and the adjusted first color input image data, one of the second color input image data and the adjusted second color input image data, and the third color input image data.

13. A driving method of a display device including a pixel unit comprising a first pixel column and a second pixel column arranged alternately along a first direction, the first pixel column and the second pixel column each comprising a first color pixel and a second color pixel such that an arrangement order of the first color pixel and the second color pixel of the first pixel column along a second direction intersecting the first direction is opposite to an arrangement order of the first color pixel and the second color pixel of the second pixel column along the second direction, and a third pixel column arranged between the first pixel column and the second pixel column, the third pixel column comprising a third color pixel arranged along the second direction, the driving method comprising:

generating an active signal in response to a mode signal provided from an outside;

comparing a difference value between a grayscale value of the first color pixel and a grayscale value of the second color pixel comprised in input image data with a reference value, which is preset, when the active signal is activated;

generating a corrected input image data by adjusting at least one grayscale value of the first color pixel and the second color pixel so that the difference value is less than or equal to the reference value when the difference value is greater than the reference value; and converting the corrected input image data into image data and outputting the image data to a data driver, wherein when the active signal is deactivated, the image data is generated by converting the input image data without adjusting the input image data.

14. The driving method of claim 13, further comprising:

selecting a portion of the pixel unit as an adjustment area by analyzing the input image data after the generating the active signal, wherein the difference value between the grayscale value of the first color pixel and the grayscale value of the second color pixel is compared with the reference value in the adjustment area.

15. The driving method of claim 13, wherein when the difference value is smaller than the reference value, the image data is generated by converting the input image data without adjusting the input image data.

16. The driving method of claim 13, wherein when the grayscale value of the second color pixel is greater than the grayscale value of the first color pixel, the grayscale value of the first color pixel is changed to be equal to the grayscale value of the second color pixel.

17. The driving method of claim 16, wherein the grayscale value of the first color pixel is gradually changed in units of image frames.

18. The driving method of claim 13, wherein the grayscale value of the first color pixel and the grayscale value of the second color pixel are changed to a predetermined grayscale value between the grayscale value of the first color pixel and the grayscale value of the second color pixel.

* * * * *